US011557856B2

(12) United States Patent
Kida et al.

(10) Patent No.: US 11,557,856 B2
(45) Date of Patent: Jan. 17, 2023

(54) CONNECTOR LOCK STRUCTURE

(71) Applicant: Yazaki Corporation, Tokyo (JP)

(72) Inventors: Kousuke Kida, Makinohara (JP); Akihiro Tsuruta, Fujieda (JP); Takuya Hasegawa, Fujieda (JP); Hiromasa Kubota, Fujieda (JP)

(73) Assignee: Yazaki Corporation, Tokyo (JP)

( * ) Notice: Subject to any disclaimer, the term of this patent is extended or adjusted under 35 U.S.C. 154(b) by 144 days.

(21) Appl. No.: 17/193,947

(22) Filed: Mar. 5, 2021

(65) Prior Publication Data

US 2021/0281013 A1 Sep. 9, 2021

(30) Foreign Application Priority Data

Mar. 9, 2020 (JP) ..... JP2020-039750

(51) Int. Cl.
*H01R 13/627* (2006.01)

(52) U.S. Cl.
CPC ..... *H01R 13/6272* (2013.01)

(58) Field of Classification Search
CPC .. H01R 13/6272; H01R 13/639; H01R 13/46; H01R 13/627
See application file for complete search history.

(56) References Cited

U.S. PATENT DOCUMENTS 5,584,719 A 12/1996 Tsuji et al.
8,777,651 B2 * 7/2014 Miyawaki ..... H01R 13/6272 439/354
9,742,115 B2 * 8/2017 Matsumoto ..... H01R 13/627
10,297,932 B2 * 5/2019 Maesoba ..... H01R 13/6477
10,305,221 B2 * 5/2019 Ohfuku ..... H01R 13/641
10,601,153 B2 * 3/2020 Maki ..... H01R 13/639
10,637,194 B1 * 4/2020 Kim ..... H01R 13/506
10,734,762 B2 * 8/2020 Kanemura ..... H01R 13/639
10,840,648 B2 * 11/2020 Hashimoto ..... H01R 13/5812
11,108,193 B2 * 8/2021 Kanemura ..... H01R 13/629
2013/0288512 A1 * 10/2013 Oka ..... H01R 13/4223 439/353
2017/0005434 A1 * 1/2017 Taguchi ..... H01R 13/4223
2020/0144769 A1 * 5/2020 Tanaka ..... H01R 13/639
2020/0251848 A1 * 8/2020 Misaiji ..... H01R 13/5025
2020/0412056 A1 * 12/2020 Mamiya ..... H01R 13/639
2021/0249819 A1 * 8/2021 Son ..... H01R 13/641
2021/0281013 A1 * 9/2021 Kida ..... H01R 13/6272
2021/0376522 A1 * 12/2021 Kida ..... H01R 13/6272
2022/0181823 A1 * 6/2022 Morishita ..... H01R 13/639

FOREIGN PATENT DOCUMENTS

JP 2010-170967 A 8/2010

* cited by examiner

*Primary Examiner* — Abdullah A Riyami
*Assistant Examiner* — Nelson R. Burgos-Guntin
(74) *Attorney, Agent, or Firm* — Banner & Witcoff, Ltd.

(57) ABSTRACT

A connector lock structure includes a lock arm that extends along a fitting direction and is formed on a side wall of a connector housing, and maintains a fitted state by being elastically engaged with a counterpart connector housing; a pair of flexible and deformable plate-shaped support walls that protrude rearward of the side wall to sandwich a rear portion of the lock arm therebetween; a coupling portion that couples each of the plate-shaped support walls to the rear portion of the lock arm in a width direction of the connector housing; and an upward protruding portion that protrudes upward than the coupling portion and is formed on each of the plate-shaped support walls.

3 Claims, 8 Drawing Sheets

CONNECTOR LOCK STRUCTURE

CROSS-REFERENCE TO RELATED APPLICATIONS

This application is based on and claims priority under 35 USC 119 from Japanese Patent Application No. 2020-039750 filed on Mar. 9, 2020, the contents of which are incorporated herein by reference.

TECHNICAL FIELD

The present invention relates to a connector lock structure.

BACKGROUND ART

A connector lock structure that is able to maintain a fitted state between a connector housing and a counterpart connector housing has been know (see, for example, Patent Literature 1).

As shown in FIG. 8, the connector lock structure disclosed in Patent Literature 1 includes a lock arm 513 provided on a second connector housing (connector housing) 511, and a lock claw locking hole (lock portion) 505 that is provided on a top portion 503 of a first connector housing (counterpart connector housing) 501 and locks a lock claw (lock protrusion) 515 of the lock arm 513.

End portions 513*a*, 513*b* of the lock arm 513 are integrally connected to a front end and a rear end of a top portion 517 of the second connector housing 511 respectively, so as to form a double-sided beam shape. Therefore, the lock arm 513 forms a bridge shape on the top portion 517 except for both end portions 513*a*, 513*b* via a gap (flexible space) 519. Therefore, the entire lock arm 513 has elasticity. The entire lock arm 513 undergoes bending deformation in a compression direction when receiving an external force, and is restored to the original bridge form by a repulsive force of the lock arm 513 when the external force is removed. The lock arm 513 is provided with a lock claw 515 at a central portion thereof.

When unlocking the first connector housing 501 and the second connector housing 511 configured as described above, a head of the lock claw 515 is pushed down by strong pressing with a finger pulp or using a jig such as a pin. As a result, the lock arm 513 is deformed downward, the lock claw 515 is positioned at a level disengaged from the locking with the lock claw locking hole 505, and further, the second connector housing 511 is separated from the first connector housing 501. As a result, the first connector housing 501 and the second connector housing 511 can be unlocked easily and quickly.

CITATION LIST

Patent Literature

Patent Literature 1: JP-A-2010-170967

However, in the above-described connector lock structure, in the fitted state between the first connector housing 501 and the second connector housing 511, a rear side of the lock arm 513 and the rear end portion 513*b* are exposed from the first connector housing 501. Therefore, when an external force is applied to the rear side of the lock arm 513, the lock arm 513 may be bent, the engagement between the lock claw 515 and the lock claw locking hole 505 may be released, and the fitted state may be impaired. The rear end portion 513*b* may be plastically deformed.

Also, when the rigidity of the rear end portion 513*b* is increased to make it difficult to bend due to an external force or to be plastically deformed, the lock arm 513 is less likely to be bent. Therefore, a force required when the lock arm 513 is fitted with the first connector housing 501 or when an unlocking operation is performed, the workability is deteriorated. When a bridge-shaped hood for preventing incorrect operation so as to cover the rear side of the lock arm 513 and the rear end portion 513*b* is provided integrally with the second connector housing 511, the size of the second connector housing 511 is increased.

SUMMARY OF INVENTION

The present invention has been made in view of the above circumstances, and an object of the present invention is to provide a compact connector lock structure that can ensure workability during connector fitting or an unlocking operation and protect the lock arm.

According to the embodiment, the connector lock structure includes:

a lock arm that extends along a fitting direction and is formed on a side wall of a connector housing, and maintains a fitted state by being elastically engaged with a counterpart connector housing;

a pair of flexible and deformable plate-shaped support walls that protrude rearward of the side wall to sandwich a rear portion of the lock arm therebetween;

a coupling portion that couples each of the plate-shaped support walls to the rear portion of the lock arm in a width direction; and an upward protruding portion that protrudes upward than the coupling portion and is formed on each of the plate-shaped support walls.

DESCRIPTION OF EMBODIMENTS

Hereinafter, an embodiment according to the present invention will be described with reference to the drawings.

Figure 1:
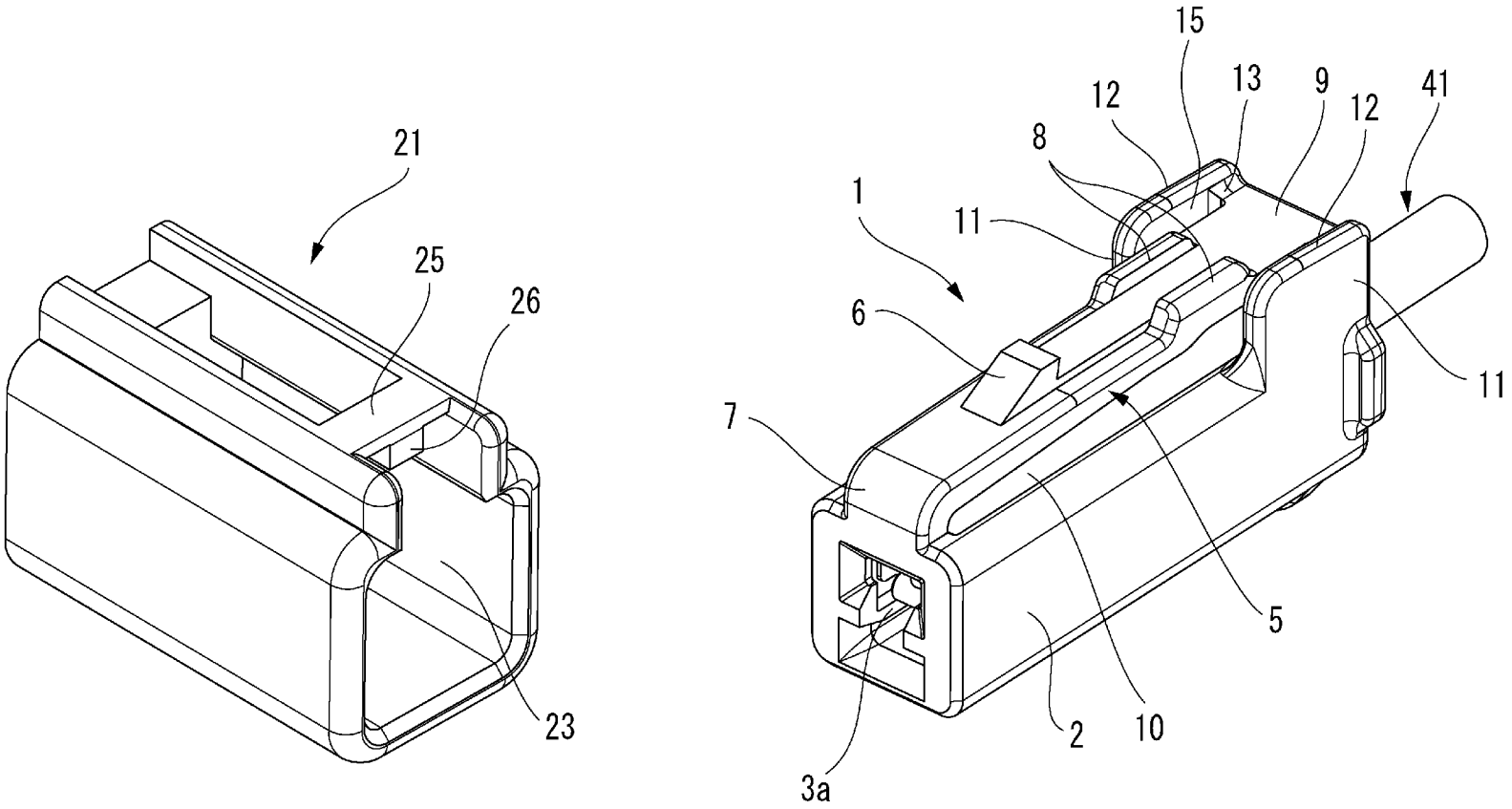
FIG. 1 is a perspective view illustrating a state before a connector housing and a counterpart connector housing of a connector lock structure according to an embodiment of the present invention are fitted with each other.
Figure 2:
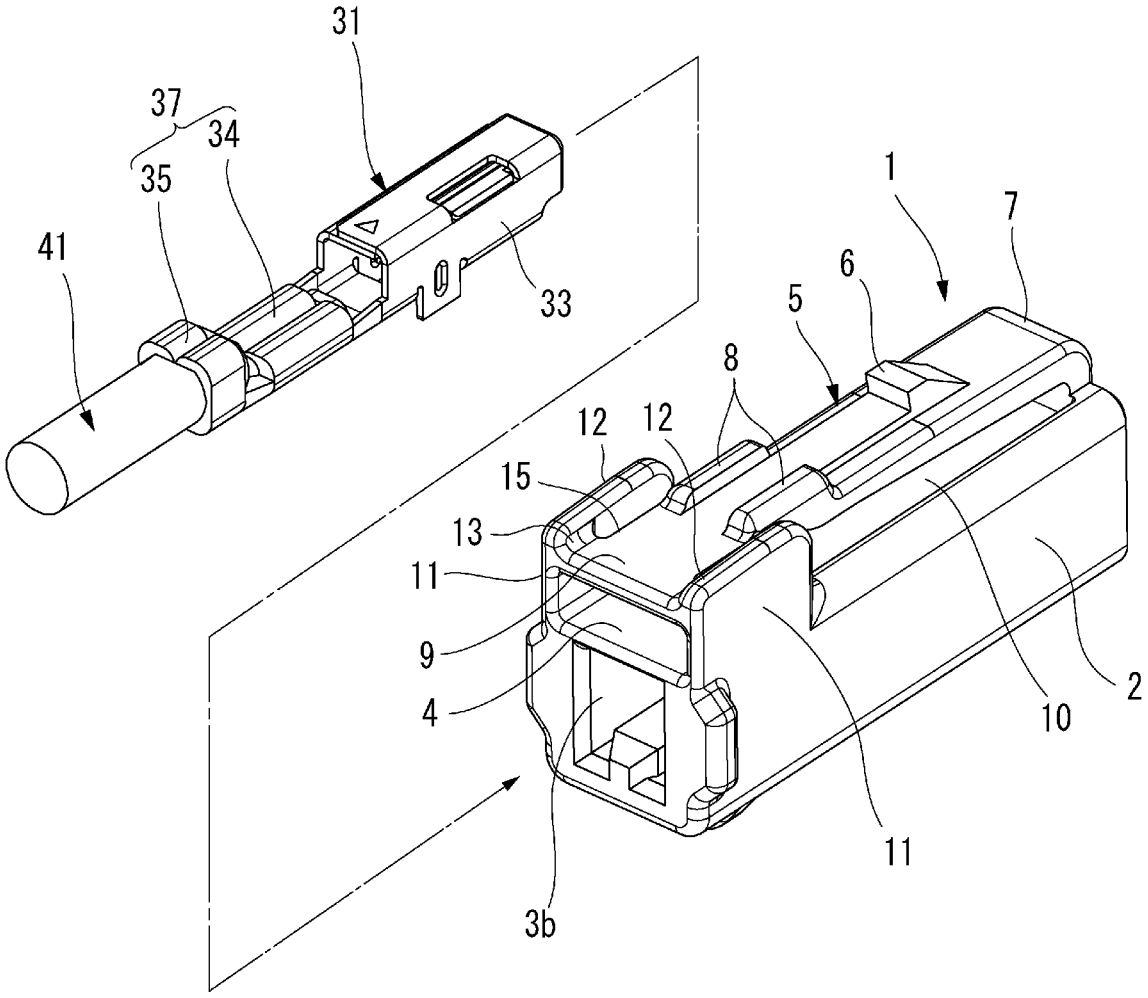
FIG. 2 is a perspective view illustrating a state before a terminal is accommodated in the connector housing illustrated in FIG. 1.
Figure 3A:
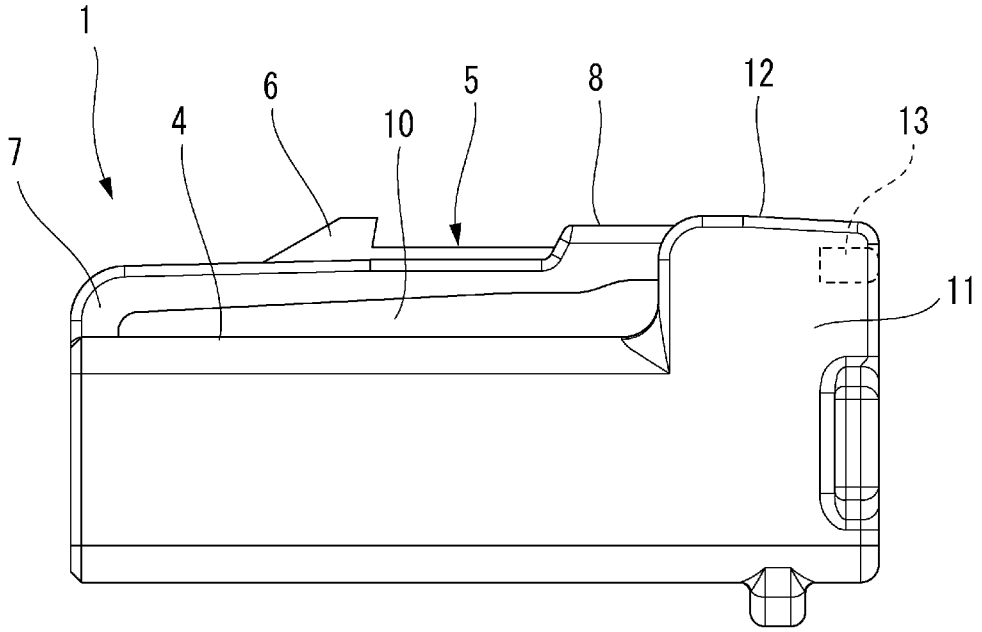
FIG. 3A is a side view of the connector housing illustrated in FIG. 1.
Figure 3B:
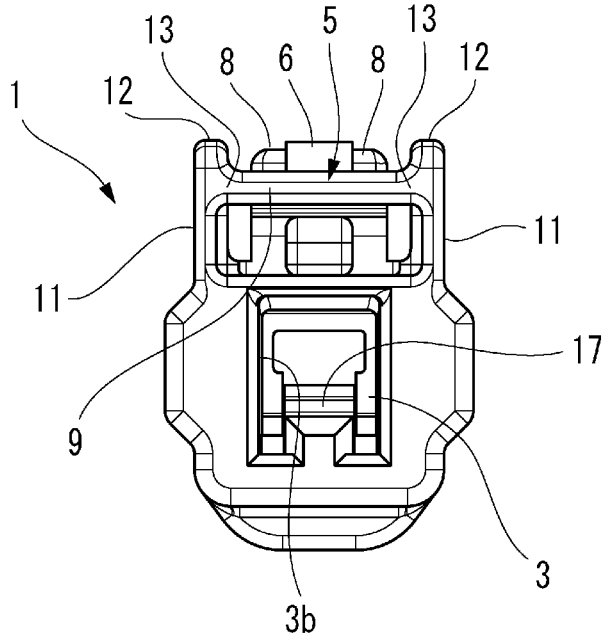
FIG. 3B is a back view of the connector housing illustrated in FIG. 1.

FIG. 1 is a perspective view illustrating a state before a connector housing 1 and a counterpart connector housing 21 of a connector lock structure according to an embodiment of the present invention are fitted with each other. FIG. 2 is a perspective view illustrating a state before a terminal is accommodated in the connector housing 1 illustrated in FIG. 1. FIGS. 3A and 3B are a side view and a back view of the connector housing 1 illustrated in FIG. 1.

As illustrated in FIG. 1, the connector lock structure according to the present embodiment includes the connector housing 1 and the counterpart connector housing 21. Here, the connector housing 1 is a female connector housing in which a female terminal 31 is accommodated in a terminal accommodating chamber 3. The counterpart connector housing 21 is a male connector housing in which a male terminal (not illustrated) is disposed in a connector fitting portion 23. In the following description, a side (left side in FIG. 3A) to be fitted into the counterpart connector housing 21 is defined as the front of the connector housing 1.

The connector lock structure according to the present embodiment mainly includes a lock arm 5 formed on an upper wall (side wall) 4 of the connector housing 1, a pair of flexible and deformable plate-shaped support walls 11, 11 protruding rearward of the upper wall 4, coupling portions 13 that respectively couple the plate-shaped support wall 11 to a rear portion 9 of the lock arm 5 in a width direction (left-right direction in FIG. 3B), and upward protruding portions 12 each of which protrudes upward than the coupling portion 13 and is formed on the plate-shaped support wall 11. Also, the width direction is a direction from one of the plate shaped support walls 11 toward the other thereof, and is a direction perpendicular to the fitting direction.

As illustrated in FIG. 1, the counterpart connector housing 21 of the present embodiment is formed as a molded article of a synthetic resin, and includes a connector fitting portion 23 having a rectangular tube shape. A fitting portion 2 of the connector housing 1 described later is to be inserted and fitted into the connector fitting portion 23 in a substantially close contact state. A tab terminal portion of the male terminal protrudes toward an opening end on a back wall of the connector fitting portion 23.

A lock portion 26 protruding into the connector fitting portion 23 is provided on a top wall 25 of the connector fitting portion 23. A lock claw (locking protrusion) 6 of the lock arm 5, which will be described later, is locked to the lock portion 26.

As illustrated in FIGS. 1 to 3B, the connector housing 1 of the present embodiment is formed as a molded article made of a synthetic resin and has a substantially rectangular tubular shape as a whole. A front half portion of the connector housing 1 serves as the fitting portion 2 that can be inserted into the connector fitting portion 23 of the counterpart connector housing 21. An inside of the connector housing 1 including the fitting portion 2 serves as the terminal accommodating chamber 3 of the female terminal 31 that receives the male terminal of the counterpart connector housing 21 through a front end opening portion 3*a*.

A cantilever-shaped lance 17 for retaining the female terminal 31 is provided in the terminal accommodating chamber 3, and the female terminal 31 inserted from a rear end opening portion 3*b* of the connector housing 1 is held by the lance 17.

As illustrated in FIG. 2, the female terminal 31 includes, for example, a box portion 33 serving as an electrical contact portion at a distal end in an insertion direction. An external appearance of the box portion 33 is a rectangular parallelepiped shape elongated in the insertion direction. Inside the box portion 33, a flat spring piece 32 that is in conduction contact with the tab terminal portion of the male terminal accommodated in the counterpart connector housing 21 is provided (see FIG. 5). In the female terminal 31, an electric wire crimping portion 37, which includes a conductor crimping portion 34 for crimping a conductor 43 and a cover crimping portion 35 for fixing an electric wire 41, is connected to the rear side of the box portion 33.

Figure 4:
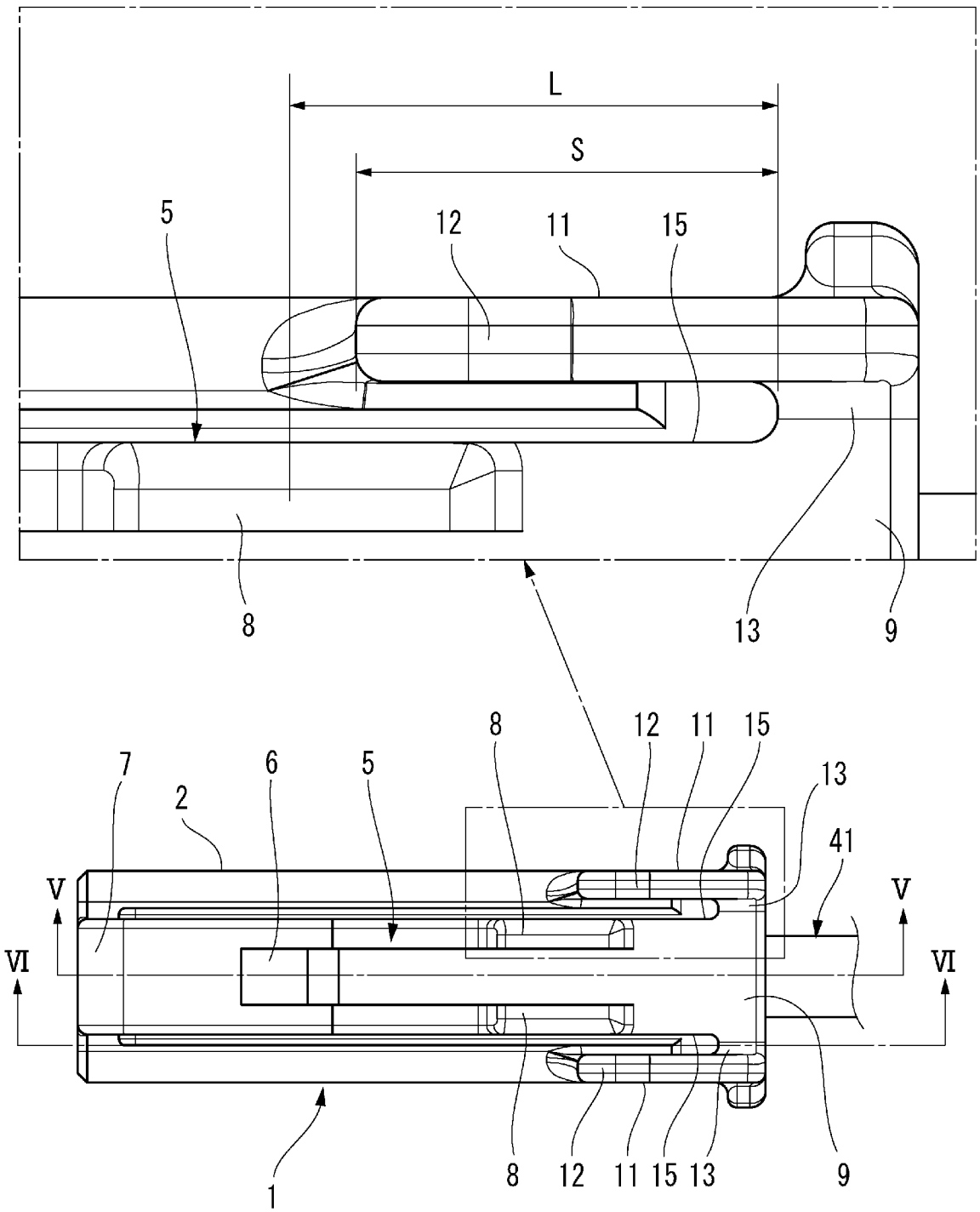
FIG. 4 is a top view and a partially enlarged view of the connector housing illustrated in FIG. 1.
Figure 5:
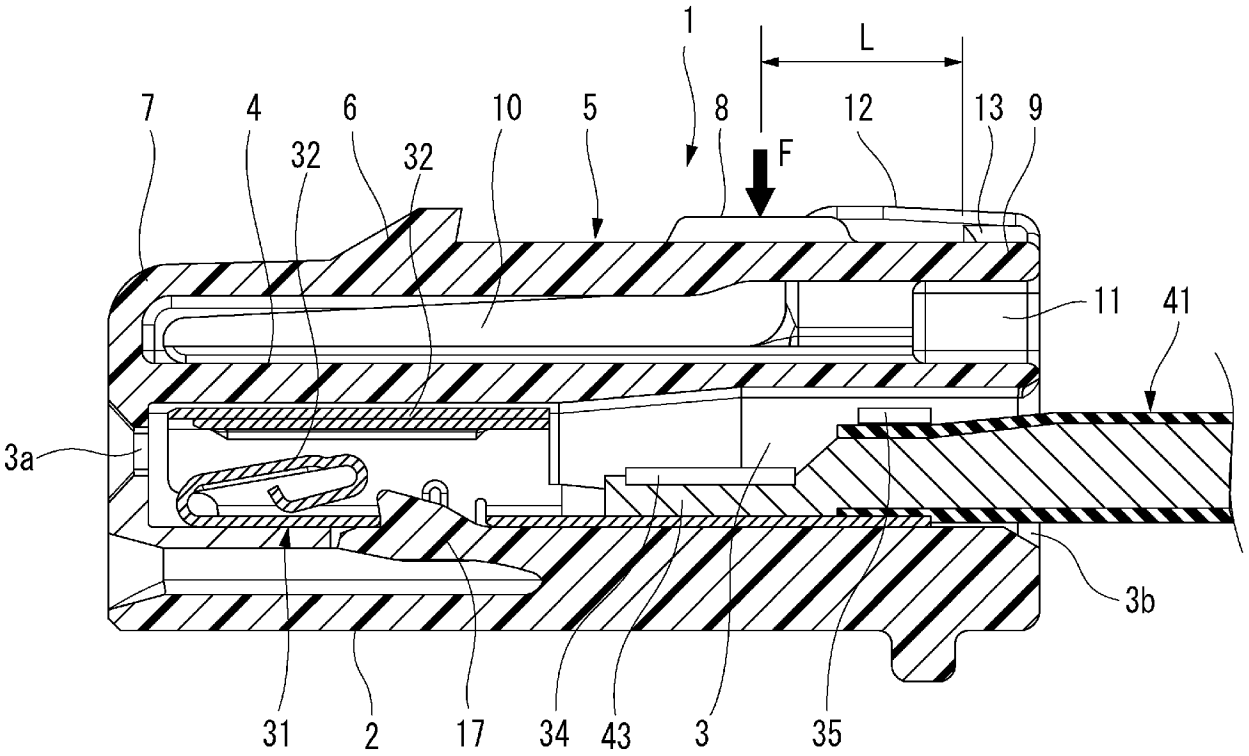
FIG. 5 is a sectional view taken along a line V-V in FIG. 4.

FIG. 4 is a top view and a partially enlarged view of the connector housing 1 illustrated in FIG. 1. FIG. 5 is a sectional view taken along a line V-V in FIG. 4.

As illustrated in FIGS. 4 and 5, the lock arm 5, which is elastically engaged with the counterpart connector housing 21 to maintain the fitted state, is formed on the upper wall 4 of the connector housing 1. A front portion 7 and the rear portion 9 of the lock arm 5 are integrally connected to a front end and a rear end of the upper wall 4 of the connector housing 1 respectively, and the rear portion 9 is formed in a bifurcated shape connected to the pair of plate-shaped support walls 11, 11 via the coupling portion 13. That is, the lock arm 5 according to the present embodiment extends along the fitting direction, and is formed on the upper wall 4 of the connector housing 1. More specifically, the lock arm 5 extends from the front of the connector housing 1 rearward in the fitting direction. Further, the lock arm 5 has a bridge shape via a flexible space (gap) 10 provided on the upper wall 4 except for the front portion 7 and the rear portion 9. Also, the fitting direction is a direction in which the connector housing 1 is fitted to the counterpart connector housing 21.

Therefore, the entire lock arm 5 has elasticity. When receiving an operation force F, the lock arm 5 is bent and deformed in a pressing direction (downward in FIG. 5). Further, when the operation force F is removed, the lock arm 5 is restored to the original bridge form by a repulsive force of the lock arm 5. In an intermediate portion of the lock arm 5, a lock claw 6 to be locked to the lock portion 26 of the counterpart connector housing 21 and a pair of operation portions 8 each including a projecting portion protruding upward between the lock claw 6 and the coupling portion 13 are integrally provided. That is, the lock arm 5 maintains the fitted state between the connector housing 1 and the counterpart connector housing 21 by locking the lock claw 6 to the lock portion 26 of the counterpart connector housing 21. When the operation portion 8 is pressed downward by a finger or the like, the operation force F is intensively applied to the operation portion 8, and thus the lock arm 5 undergoes bending deformation to form a projecting shape downward.

The pair of flexible and deformable plate-shaped support walls 11, 11 according to the present embodiment protrude upward and are provided in parallel on a rear side of the upper wall 4 so as to sandwich the rear portion 9 of the lock arm 5 therebetween from the width direction. The plate-shaped support wall 11 is bent and deformed in the width direction (plate thickness direction), while the plate thickness and a length in the fitting direction are appropriately set so as to have a predetermined rigidity in a protruding direction (plate surface direction). Also, the protruding direction is a direction perpendicular to the width direction and the fitting direction.

An upper end portion of the plate-shaped support wall 11 serves as the upward protruding portion 12 that protrudes upward than the coupling portion 13 coupled to the lock arm 5. The upward protruding portion 12 protrudes upward than the operation portion 8 of the lock arm 5. The upward protruding portion 12 is not limited to one formed by causing the entire upper end portion of the plate-shaped support wall 11 to protrude upward as in the present embodiment, and may be formed by causing a portion of the upper end portion of the plate-shaped support wall 11 upward.

As illustrated in FIG. 4, each of the coupling portions 13 according to the present embodiment couples a width-direction end of the rear portion 9 of the lock arm 5 to an inner wall surface of the plate-shaped support wall 11 in the width direction. Therefore, when the intermediate portion of the lock arm 5 is pushed downward and bent downward, a force that causes the plate-shaped support wall 11 to bend inward in the width direction also acts on the plate-shaped support wall 11 via the coupling portion 13. That is, when the lock claw 6 of the lock arm 5 is pushed downward by the lock portion 26 of the counterpart connector housing 21 during the connector fitting, or when the operation portions 8 of the lock arm 5 are pushed downward by the operation force F during the unlocking operation, the plate-shaped support walls 11 supporting the rear portion 9 of the lock arm 5 are also bent together with the lock arm 5 itself. Therefore, the repulsive force can be reduced as compared with the case where only the lock arm 5 is bent.

Further, in the coupling portion 13 of the present invention, a coupling length extending along the fitting direction, which is a longitudinal direction of the lock arm 5 and the plate-shaped support wall 11, is shortened by a slit 15 provided on a front side of the coupling portion 13. That is, a distance L from the operation portion 8, to which the operation force F of pressing the intermediate portion of the lock arm 5 downward is applied, to the coupling portion 13 is increased by an amount corresponding to the slit 15. Therefore, a force, which causes the plate-shaped support walls 11 to bend in the width direction via the coupling portions 13 when the lock arm 5 itself is bent downward, is increased by the action of leverage.

Next, the operation of the above-described configurations will be described.

Figure 6A:
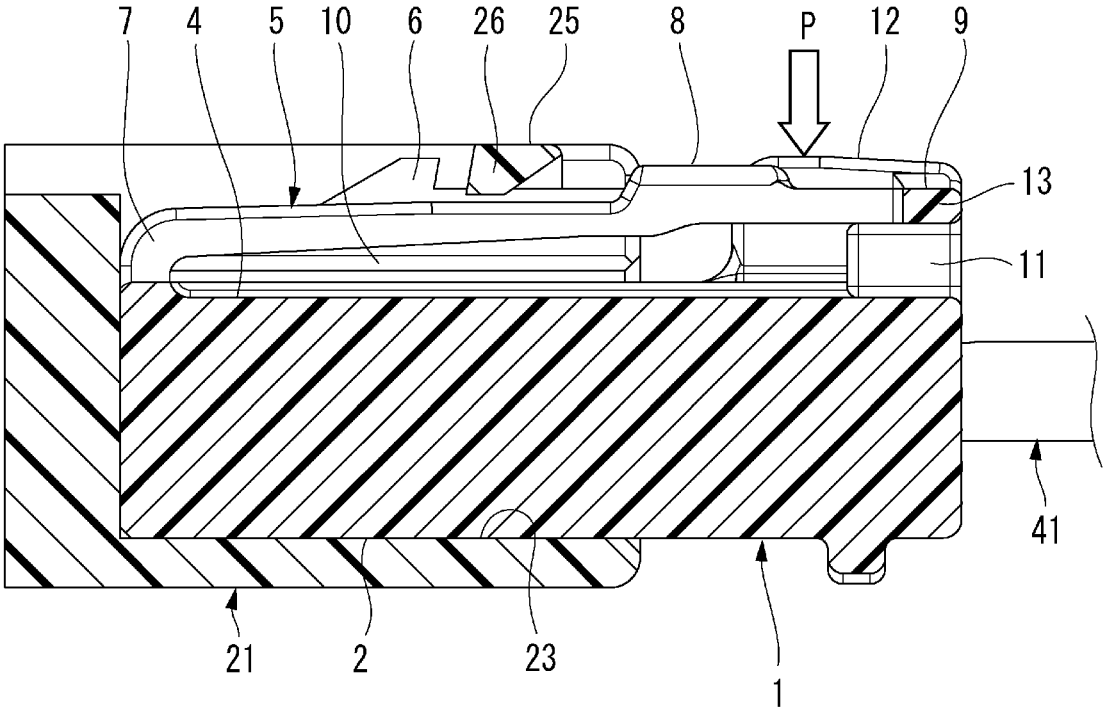
FIGS. 6A and 6B are a cross-sectional view taken along a line VI-VI in FIG. 4 and a back view, respectively.
Figure 6B:
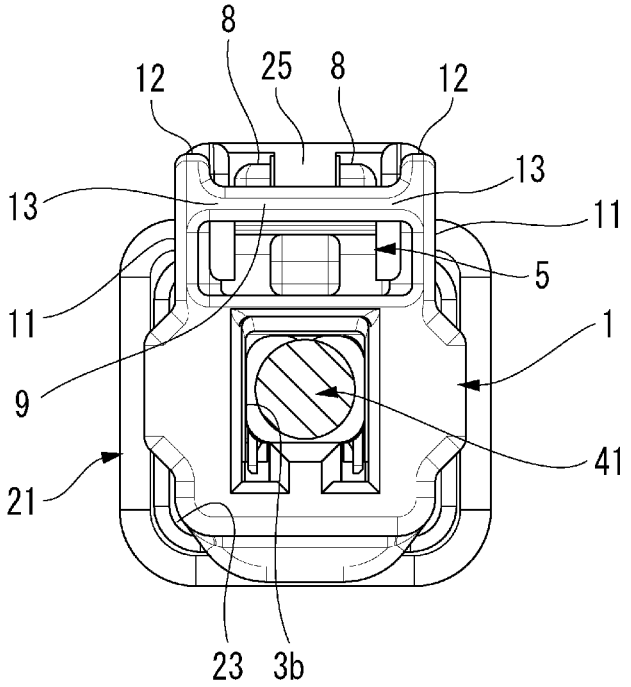
Figure 7A:
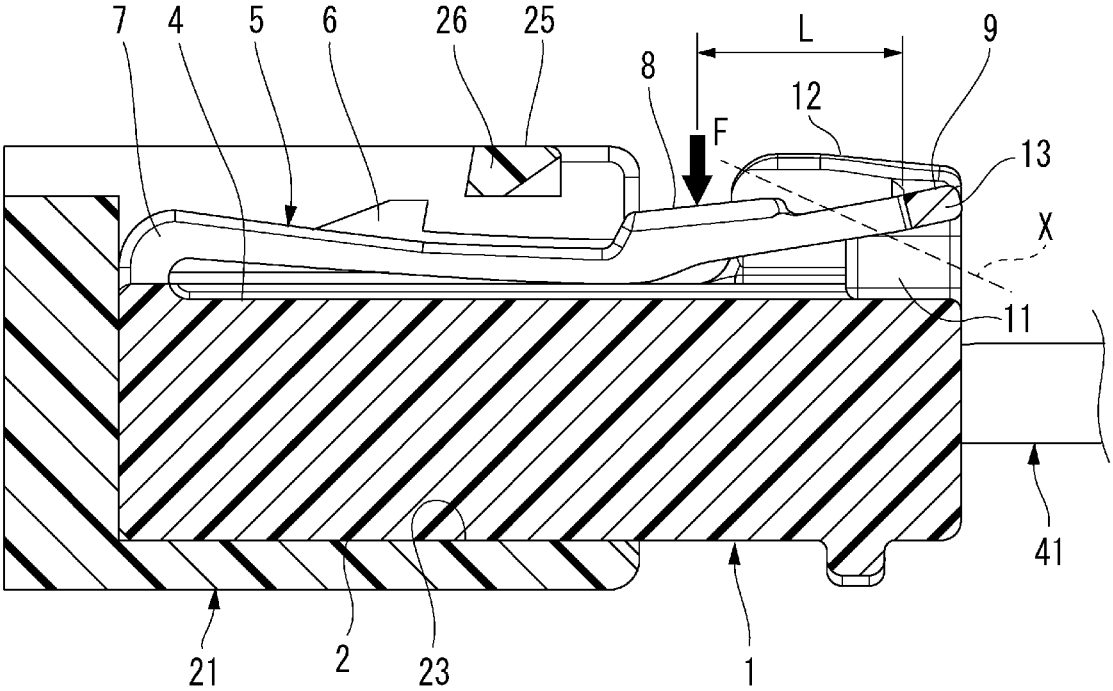
FIGS. 7A and 7B are illustrative diagrams showing an unlocking operation of the connector housing illustrated in FIGS. 6A and 6B.
Figure 7B:
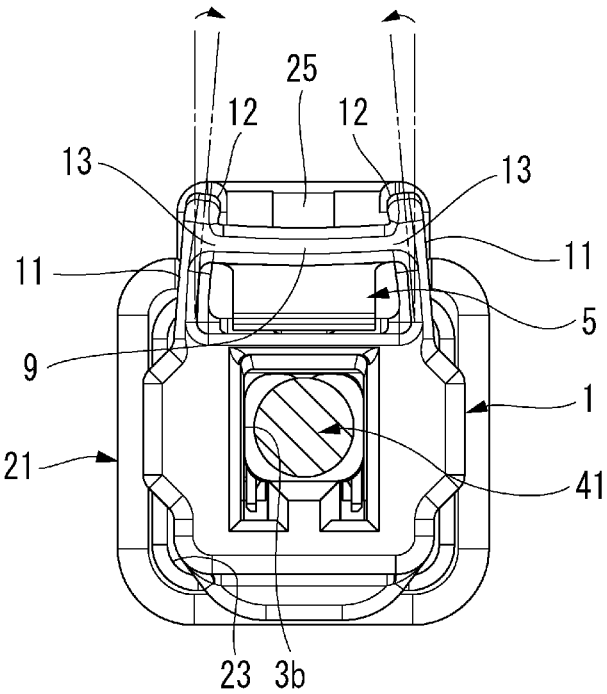
Figure 8:
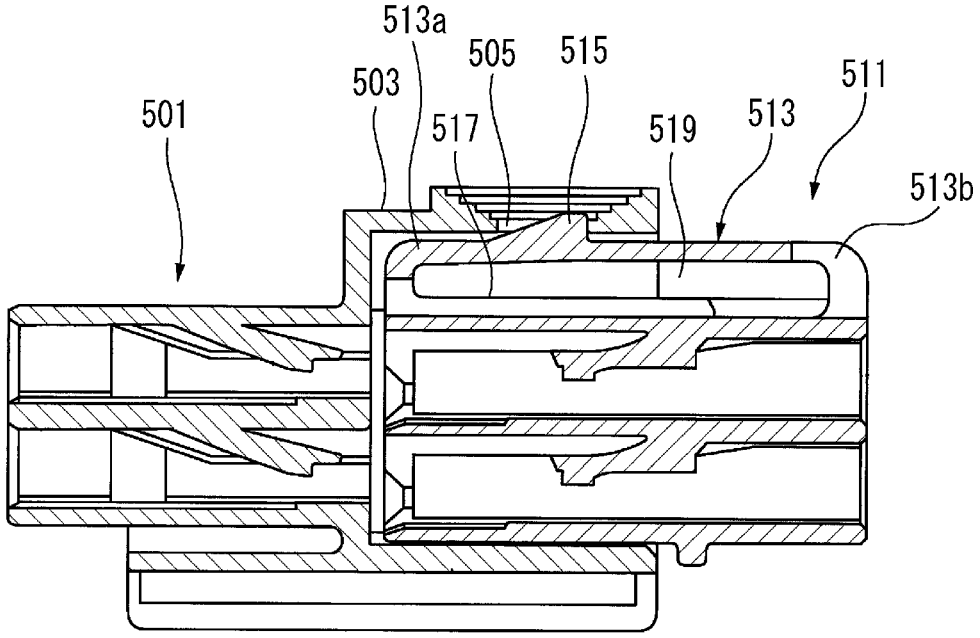
FIG. 8 is an illustrative diagram showing a fitting operation of the first connector housing and the second connector housing in the related art.

FIGS. 6A and 6B are a cross-sectional view taken along a line VI-VI in FIG. 4 and a back view, respectively. FIGS. 7A and 7B are illustrative diagrams showing an unlocking operation of the connector housing 1 illustrated in FIGS. 6A and 6B.

According to the connector lock structure of the present embodiment, the connector housing 1 is in a state in which the rear side of the lock arm 5 and the rear side of the fitting portion 2 are exposed from the connector fitting portion 23 of the counterpart connector housing 21 in the fitted state between the connector housing 1 and the counterpart connector housing 21 as illustrated in FIGS. 6A and 6B. However, when an undesired external force P directed downward from above is applied to the lock arm 5, for example, in a case where an object hits the lock arm 5, the external force P is received by the upward protruding portion 12 of the plate-shaped support wall 11. Here, the plate-shaped support wall 11 undergoes bending deformation in the width direction (plate thickness direction), but the external force P applied to the upward protruding portion 12 can be received since the plate-shaped support wall 11 has a rigidity in the protruding direction (plate surface direction). Therefore, bending of the lock arm 5 itself due to the external force P is prevented (inhibited).

Therefore, the upward protruding portion 12 of the compact plate-shaped support wall 11 prevents the fact that the engagement with the counterpart connector housing 21 is released and the fitted state is impaired due to the bending of the lock arm 5 itself when the external force P is applied to the lock arm 5 of the connector housing 1. Further, the upward protruding portion 12 of the plate-shaped support wall 11 also prevents plastic deformation of the lock arm 5 due to the external force P. That is, the connector housing 1 does not increase in size, for example, as in a case where a bridge-shaped hood for preventing incorrect operation that covers the rear side of the lock arm 5 and the rear portion 9 is provided integrally with the connector housing 1.

On the other hand, when unlocking is performed, as shown in FIGS. 7A and 7B, the operation portion 8 provided at the intermediate portion of the lock arm 5 is pushed downward by the operating force F, so that the lock arm 5 itself can be bent downward, and the pair of plate-shaped support walls 11, 11 can be bent inward in the width direction via the coupling portions 13. Therefore, the operation force F required during the unlocking operation is prevented (inhibited) from increasing. Similarly, when the lock claw 6 of the lock arm 5 is pushed downward by the lock portion 26 of the counterpart connector housing 21 during the connector fitting, a fitting force required during the connector fitting is prevented (inhibited) from increasing. Therefore, workability during the connector fitting or the unlocking operation can be ensured.

Further, according to the connector lock structure of the present embodiment, the distance L from the operation portion 8 to the coupling portion 13 when the intermediate portion of the lock arm 5 is pushed downward is increased by an amount corresponding to the slit 15. As shown in FIGS. 7A and 7B, a force, which causes the plate-shaped support wall 11 to bend inward in the width direction along a folding line X via the coupling portion 13 when the lock arm 5 itself is bent downward, can be increased by the action of leverage. Therefore, the operation force F required during the unlocking operation can be further reduced.

Further, according to the connector lock structure of the present embodiment, the operation force F of pressing the intermediate portion of the lock arm 5 downward is intensively applied to the lock arm 5 via the operation portion 8 including the projecting portion. Therefore, the action of the leverage, which increases the force causing the plate-shaped support wall 11 to bend when the distance L from the operation portion 8 to the coupling portion 13 is increased, is applied reliably.

Therefore, according to the connector lock structure of the above embodiment, it is possible to provide a compact connector lock structure that can ensure workability during the connector fitting or the unlocking operation and protect the lock arm 5.

Incidentally, the present invention is not limited to the above-described embodiment, but may be appropriately modified, improved or the like. In addition, the material, shape, size, number, arrangement position or the like of each component in the above-described embodiment are optional and are not limited as long as the present invention can be achieved.

The features of the connector lock structure according to the present invention will be briefly summarized in the following [1] to [3].

[1] A connector lock structure including:

a connector housing (1) that is able to be fitted to a counterpart connector housing (21);

a lock arm (5) that extends along a fitting direction and is formed on a side wall (upper wall 4) of the connector housing (1), and maintains a fitted state by being elastically engaged with the counterpart connector housing (21);

a pair of flexible and deformable plate-shaped support walls (11, 11) that protrude rearward of the side wall to sandwich a rear portion (9) of the lock arm (5) therebetween;

a coupling portion (13) that couples each of the plate-shaped support walls to the rear portion of the lock arm in a width direction of the connector housing (1) perpendicular to the fitting direction; and an upward protruding portion (12) that protrudes upward than the coupling portion and is formed on each of the plate-shaped support walls.

According to the connector lock structure having a configuration of the above (1), when an undesired external force directed downward from above is applied to the lock arm, for example, in a case where an object hits the lock arm, the external force is received by the upward protruding portion of the plate-shaped support wall. Here, the plate-shaped support wall undergoes bending deformation in the width direction (plate thickness direction), but the external force applied to the upward protruding portion can be received since the plate-shaped support wall has a rigidity in the protruding direction (plate surface direction). Therefore, bending of the lock arm itself due to the external force is prevented (inhibited). Therefore, the upward protruding portion of the compact plate-shaped support wall prevents the fact that the engagement with the counterpart connector housing is released and the fitted state is impaired due to the bending of the lock arm itself when the external force is applied to the lock arm of the connector housing. Further, the upward protruding portion of the plate-shaped support wall also prevents plastic deformation of the lock arm due to the external force.

On the other hand, in the case of the connector fitting or performing unlocking, an intermediate portion of the lock arm is pressed downward, so that the lock arm itself can be bent downward and the plate-shaped support wall can be bent in the width direction via the coupling portion. Therefore, the force (operation force) required during the connector fitting or the unlocking operation is prevented (inhibited) from increasing. Therefore, workability during the connector fitting or the unlocking operation can be ensured.

[2] The connector lock structure according to the above [1], in which a coupling length of the coupling portion along the fitting direction is reduced due to a slit (15) provided on a front side of the coupling portion (13).

According to the connector lock structure having a configuration of the above (2), the distance from the operation portion to the coupling portion when the intermediate portion of the lock arm is pushed downward is increased by an amount corresponding to the slit. Therefore, a force, which causes the plate-shaped support walls to bend in the width direction via the coupling portions when the lock arm itself is bent downward, can be increased by the action of leverage. Therefore, the force (operation force) required during the unlocking operation can be further reduced.

[3] The connector lock structure according to the above [2], in which an intermediate portion of the lock arm (5) includes:

a locking protrusion (lock claw 6) to be locked to a lock portion (26) of the counterpart connector housing (21); and an operation portion (8) including a projecting portion protruding upward between the locking protrusion and the coupling portion (13).

According to the connector lock structure having a configuration of the above (3), the operation force of pressing the intermediate portion of the lock arm downward is intensively applied to the lock arm via the operation portion including the projecting portion. Therefore, the action of the leverage, which increases the force causing the plate-shaped support wall to bend when the distance from the operation portion to the coupling portion is increased, is applied reliably.

According to the connector lock structure of the present invention, it is possible to provide a compact connector lock structure that can ensure workability during the connector fitting or the unlocking operation and protect the lock arm.

What is claimed is:

1. A connector lock structure comprising:

a connector housing that is able to be fitted to a counterpart connector housing;

a lock arm that extends along a fitting direction and is formed on a side wall of the connector housing, and maintains a fitted state by being elastically engaged with the counterpart connector housing;

a pair of flexible and deformable plate-shaped support walls that are disposed rearward of the side wall to sandwich a rear portion of the lock arm therebetween;

a coupling portion that couples each of the plate-shaped support walls to the rear portion of the lock arm in a width direction of the connector housing; and an upward protruding portion that protrudes upward the coupling portion above the rear portion of the lock arm in an upward direction orthogonal to the fitting direction and the width direction, and is formed on each of the plate-shaped support walls.

2. The connector lock structure according to claim 1, wherein a coupling length of the coupling portion along the fitting direction is reduced due to a slit provided on a front side of the coupling portion.

3. The connector lock structure according to claim 1, wherein an intermediate portion of the lock arm includes:

a locking protrusion to be locked to a lock portion of the counterpart connector housing, the locking protrusion being forward of the upward protruding portion in the fitting direction; and an operation portion including a projecting portion protruding upward between the locking protrusion and the coupling portion.

* * * * *